US007799107B2

(12) United States Patent
Corney et al.

(10) Patent No.: US 7,799,107 B2
(45) Date of Patent: Sep. 21, 2010

(54) SELF-SEALING BAG ARRANGEMENT FOR A FLOOR CLEANING DEVICE

(75) Inventors: Richard E. Corney, Akron, OH (US); Jonathan E. Fawcett, Tallmadge, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 556 days.

(21) Appl. No.: 11/603,594

(22) Filed: Nov. 22, 2006

(65) Prior Publication Data

US 2007/0214755 A1 Sep. 20, 2007

Related U.S. Application Data

(60) Provisional application No. 60/782,465, filed on Mar. 15, 2006.

(51) Int. Cl.
*B01D 46/02* (2006.01)

(52) U.S. Cl. ..... 55/367; 55/369; 55/377; 55/378; 55/361; 55/374; 55/375; 55/DIG. 2; 55/DIG. 3; 15/347; 15/349; 15/351; 15/352; 15/339

(58) Field of Classification Search ..... 55/367, 55/369, 377, 378, DIG. 2, DIG. 3, 361, 374, 55/375; 15/347, 349, 351, 352, 339
See application file for complete search history.

(56) References Cited

U.S. PATENT DOCUMENTS 4,738,697 A * 4/1988 Westergren ..... 55/376
5,064,455 A * 11/1991 Lackner ..... 55/375
5,092,915 A * 3/1992 Lackner ..... 55/375
5,230,724 A * 7/1993 Marafante et al. ..... 55/367
5,464,460 A * 11/1995 Bosses ..... 55/374
5,468,271 A * 11/1995 Sauer et al. ..... 55/357
5,468,272 A * 11/1995 Schmierer ..... 55/367
5,472,460 A * 12/1995 Schmierer ..... 55/367
5,472,465 A * 12/1995 Schmierer ..... 55/367
5,725,620 A 3/1998 Perea et al.
5,766,283 A * 6/1998 Bumb et al. ..... 55/367
5,771,529 A * 6/1998 Brule et al. ..... 15/339
5,772,712 A * 6/1998 Perea et al. ..... 55/367

(Continued)

FOREIGN PATENT DOCUMENTS

DE 19544568 6/1996

(Continued)

*Primary Examiner*—Robert A Hopkins
*Assistant Examiner*—Minh-Chau T Pham
(74) *Attorney, Agent, or Firm*—Michael Best & Friedrich LLP

(57) ABSTRACT

A filtration bag assembly may include an air permeable bag and a collar affixed thereto. The collar may include an opening that communicates with the interior of said bag and at least one panel that is movable to selectively obscure the opening. The collar includes a bottom surface and a pair of opposed tabs extending laterally from opposed lateral edges of the collar. A bracket is secured to the floor cleaning apparatus and includes a pair of opposed legs, that each includes a first ramp surface and a second ramp surface. During insertion of the collar into said bracket, the first ramp surface slidingly contacts the bottom surface and the second ramp surface slidingly contacts said tabs to move the collar upwardly into fluid communication with a nozzle.

15 Claims, 21 Drawing Sheets

U.S. PATENT DOCUMENTS

| | | | | |
|---|---|---|---|---|
| 5,820,643 | A | 10/1998 | Lienenluke et al. | |
| 5,935,280 | A * | 8/1999 | Lee | 55/378 |
| 6,033,451 | A * | 3/2000 | Fish et al. | 55/374 |
| 6,136,056 | A * | 10/2000 | Krehan | 55/367 |
| 6,746,501 | B1 | 6/2004 | Wilder et al. | |
| 7,024,724 | B2 * | 4/2006 | Ponjican et al. | 15/347 |
| 7,118,607 | B2 * | 10/2006 | Bott et al. | 55/374 |
| 7,254,865 | B2 * | 8/2007 | Bosses | 15/327.2 |
| 7,258,709 | B2 * | 8/2007 | Ponjican et al. | 55/374 |
| 7,468,083 | B2 * | 12/2008 | Davis et al. | 55/362 |

FOREIGN PATENT DOCUMENTS

| | | |
|---|---|---|
| DE | 10203436 | 8/2003 |
| EP | 0555655 | 8/1993 |
| EP | 0627189 | 12/1994 |
| EP | 0671142 | 9/1995 |
| EP | 0787460 | 8/1997 |
| EP | 0796586 | 9/1997 |
| EP | 0891739 | 1/1999 |
| SE | 9604488 | 6/1998 |
| WO | 98/17164 | 4/1998 |
| WO | 98/38900 | 9/1998 |

* cited by examiner

SELF-SEALING BAG ARRANGEMENT FOR A FLOOR CLEANING DEVICE

CROSS-REFERENCE TO RELATED APPLICATIONS

This application claims the benefit of U.S. Provisional Patent Application No. 60//782,465 filed Mar. 15, 2006, the entire contents of which are hereby incorporated by reference herein.

TECHNICAL FIELD

The invention relates generally to a filtration bag attachment arrangement for a floor care appliance. More specifically, the invention relates to a filtration bag attachment arrangement that seals the bag upon removal to prevent trapped debris from exiting the bag.

BACKGROUND OF THE INVENTION

Vacuum cleaners have long employed filtration bags to capture dust and other unwanted matter that is removed from a surface being cleaned. Such bags retain the dust and debris until the user chooses to remove and discard the bag. However, upon removal, the input orifice of the bag often became a potential location which dust and debris escaped the bag, causing new messes.

Thus, there exists a need in the art for a filtration bag attachment arrangement that self-seals as it is removed from the vacuum cleaner. Further, there is a need for such an arrangement that easily and conveniently is installed and removed from the vacuum cleaner.

DETAILED DESCRIPTION OF ILLUSTRATIVE EMBODIMENTS

Figure 1:
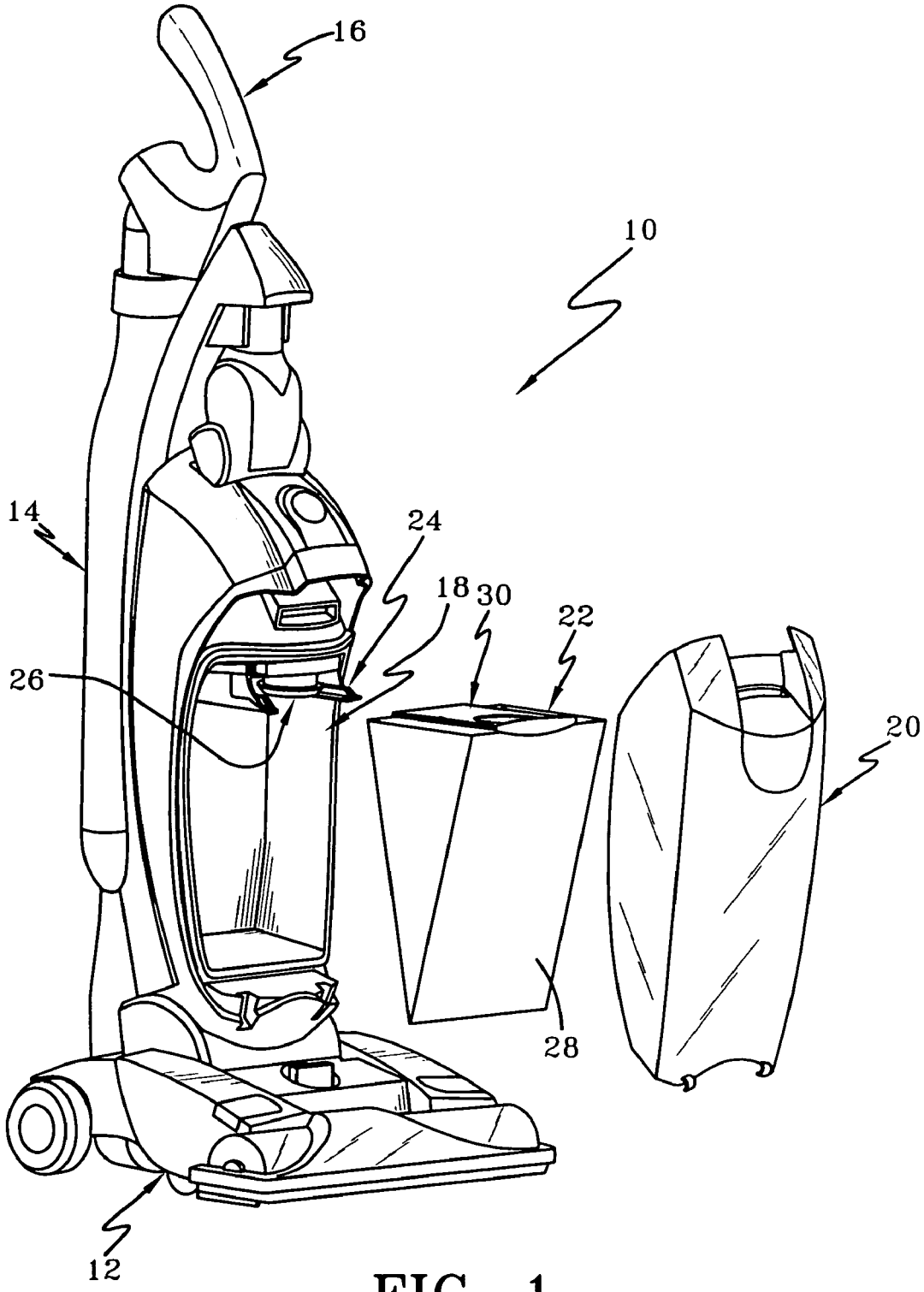
FIG. 1 is a partial assembly view of a floor cleaning device according to the present invention.

A vacuum cleaner made in accordance with the present invention is indicated generally by the numeral 10. Vacuum cleaner 10 is known in the art as an upright vacuum cleaner, and includes a foot portion 12 that is pivotally attached to an upright body 14. Foot portion 12 is adapted to move along a surface to be cleaned and, through the application of a vacuum, and optionally rotating brushes, removes dirt and other particulates from a surface. Body 14 may include a handle 16 that a user may grip to move and control vacuum 10. Body 14 also includes a filtration bag compartment 18 that is accessible via a removable cover 20. Compartment 18 is adapted to receive and carry a filtration bag assembly 22 therein and, to that end, includes a bag retaining bracket 24 positioned proximate to the upper surface of compartment 18. Bracket 24 is adapted to selectively receive and secure bag assembly 22 inside compartment 18. Bracket 24 is further adapted to align a vacuum exhaust nozzle 26 with an opening in bag assembly 22. It should be appreciated that other vacuum arrangements may be used in conjunction with the present invention, for example, vacuum cleaner 10 may be in the form of a canister vacuum cleaner or the like.

Filtration bag assembly 22 includes a bag 28 that is adapted to receive and secure dirt and other debris therein. Bag 28 may be made of a fibrous material that is air permeable, but otherwise retains particulate matter suspended in the air traveling into bag 28. In one or more embodiments, bag 28 may include a plurality of overlapping layers. In other embodiments bag 28 may be a HEPA filter. In any event, a collar 30 is secured to the top, open end of bag 26.

Referring now to FIGS. 2-6, collar 30 may be semi-rigid and provide a sturdy mounting surface for securing bag 28 within chamber 18. Further, collar 30 includes a self-sealing arrangement that selectively prevents bag contents from escaping. Collar 30 includes a generally flat, rectangular shaped bottom panel 32 having a bottom surface 33 and a top surface 34. The open end of bag 28 may be secured to bottom surface 33 by adhesive, mechanical fasteners, stitching, heat welding or the like. It should be appreciated that bag 28 is not secured to bottom panel 32 along the outer periphery thereof, but in areas offset from the edges. As will be appreciated, this allows collar 30 to be slidably inserted into bracket 24 without interference from bag 28. Bottom panel 32 may be made of a semi-rigid or rigid resilient material such as cardboard, plastic, or the like and includes an aperture 35. In this manner, the open end of bag 28 is sealed by bottom panel 32, and the interior volume of bag 28 is accessible via aperture 35. A wing 37 extends outwardly from each lateral edge 40 of panel 32. As will become apparent, wings 37 are provided to aid with proper positioning within bracket 24.

Bottom panel 32 may further include a plurality of feet 42 that extend downwardly from various locations on bottom surface 33. In the present embodiment, a pair of feet may be positioned proximate to opposed ends of the rear edge 44 of bottom panel 32. Feet 42 may also be positioned on and extend downwardly from each wing 37. Feet 42 may be provided to improve alignment and positioning of collar 30 and to promote better sliding motion along bracket 24. Bottom panel 32 may also include a catch 46 extending downwardly from bottom surface 33. Catch 46 may be generally parallel with, and spaced from, rear edge 44. In the present embodiment, catch 46 is in the form of an inverted triangle but other shapes may be employed. In the present embodiment, catch 46 does not extend the entire lateral width of bottom panel 32 and instead stops short of each lateral edge 40. As will become apparent, catch 46 is provided to promote sealing of bag assembly 22 during removal from filtration bag compartment 18.

A top panel 48 is slidably secured to bottom panel 32. To that end, bottom panel 32 includes a plurality of retaining clips 50A and 50B that extend upwardly from opposed lateral edges 40. Each retaining clip 50 may include a post portion 52 and an inwardly extending tip 54. In the present embodiment, four retaining clips are provided, though it should be appreciated that any number may be used. Top panel 48 is secured between inwardly extending tip 54 and top surface 34 of bottom panel 32. In this manner, top panel 48 may slide relative to bottom panel 32 but is held in surface to surface contact therewith.

Top panel 48 includes an aperture 56 that may be relatively larger in diameter than aperture 35 of bottom panel 32. As will become apparent, when top panel 48 is in a first sliding position, shown in FIGS. 2 and 4, aperture 56 aligns with aperture 35 of bottom panel 32, allowing dirt laden air to travel from nozzle 26 to the interior of bag 28. When top panel 48 is in a second sliding position, shown in FIGS. 3, 5 and 6, aperture 56 is displaced from aperture 35 and top panel 48 obstructs aperture 35. In this manner, collar 30 may be oriented in the first sliding position to enable dirt laden air to communicate with the bag interior via apertures 35. Further, the second sliding position is provided that seals aperture 35. When in the second sliding position, dirt and debris is contained within bag 28 and filtration bag assembly 22 may be disposed without concern that dirt within bag 28 will escape.

Figure 2:
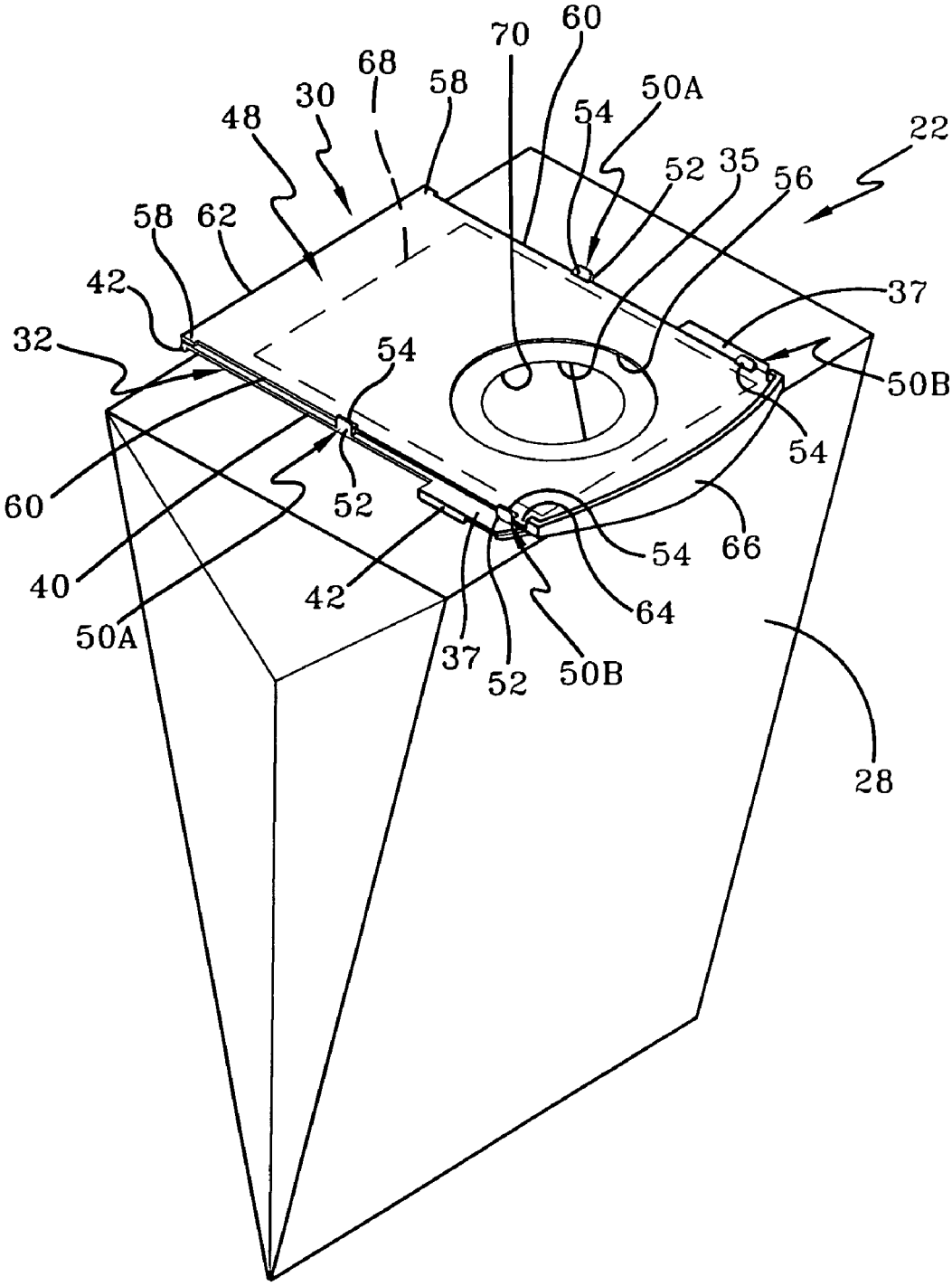
FIG. 2 is an isometric view of the filtration bag assembly according to the present invention.
Figure 3:
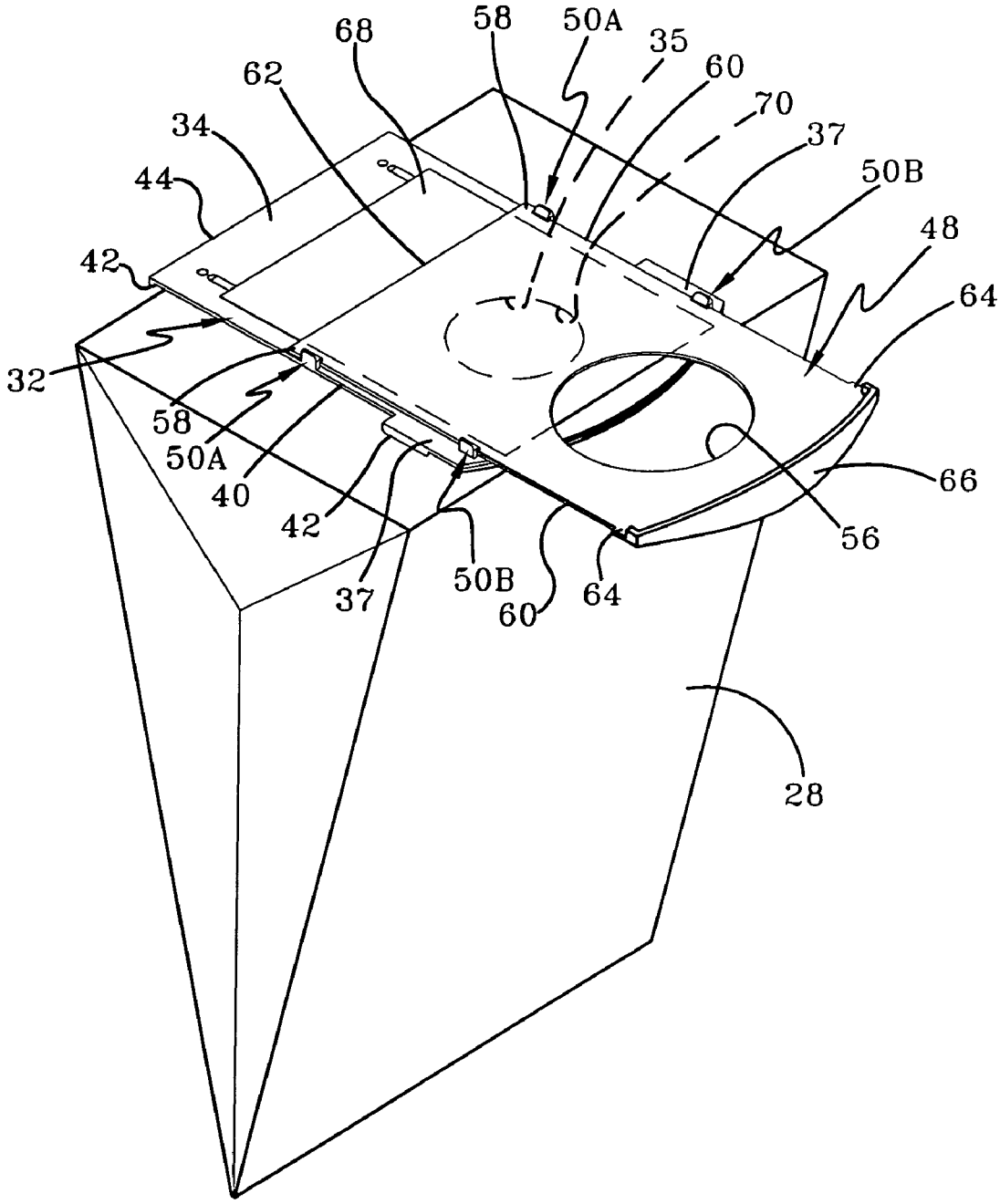
FIG. 3 is an isometric view of the filtration bag assembly of FIG. 2 in a closed orientation.
Figure 4:
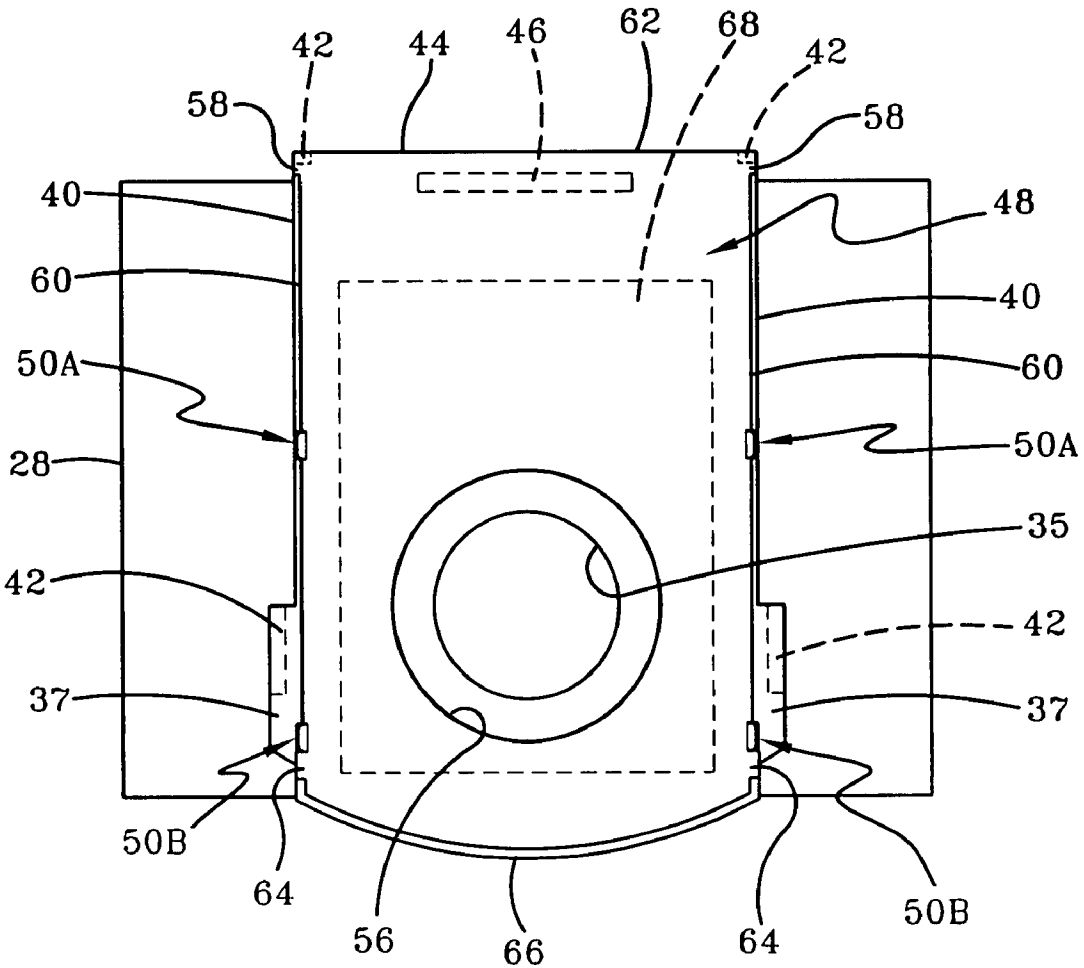
FIG. 4 is a top view of the filtration bag assembly of FIG. 2 in an open orientation.
Figure 5:
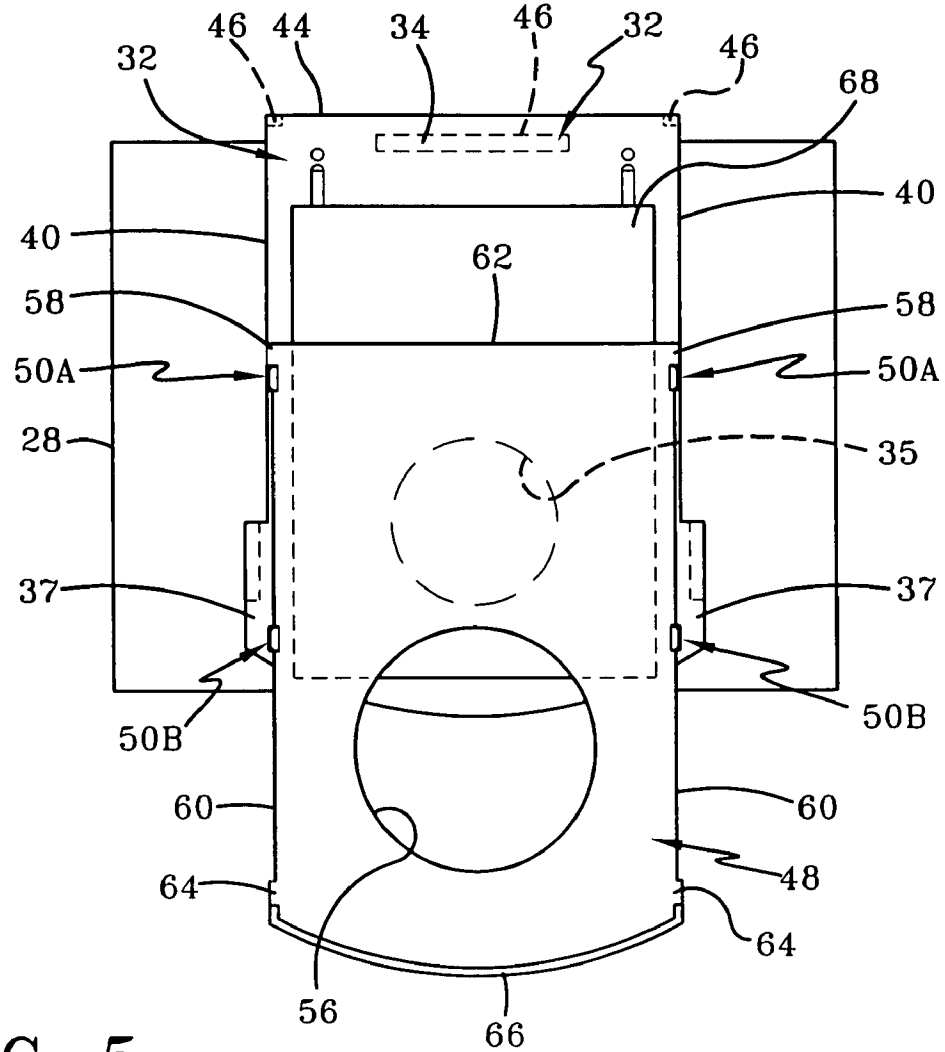
FIG. 5 if a top view of the filtration bag assembly of FIG. 2 in a closed orientation.
Figure 6:
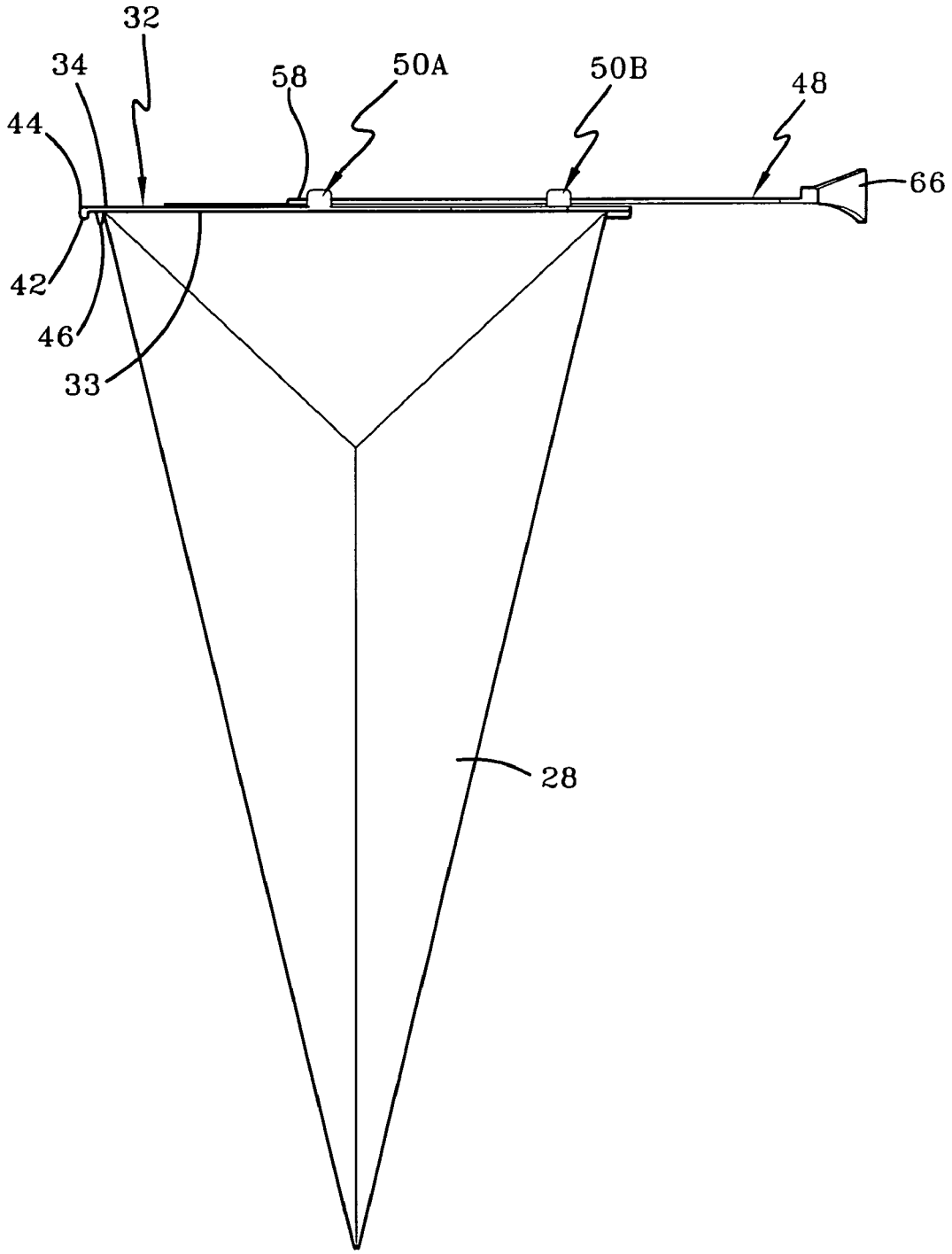
FIG. 6 is a side view of the filtration bag assembly of FIG. 2 in a closed orientation.

The sliding motion of top panel 48 is limited to prevent top and bottom panels 48 and 32 from separating. Top panel 48 includes a pair of rear stops 58 that extend outwardly from lateral edges 60, proximate the rear edge 62 of top panel 48. Rear stops 58 limit the forward sliding travel of top panel 48 relative to bottom panel 32. As shown in FIGS. 3 and 5, when top panel 48 is drawn forward relative to bottom panel 32, moving aperture 56 out of alignment with aperture 35, rear stops 58 engage retaining clips 50A to prevent the panels from dislocating. Likewise, a pair of forward stops 64 extend outwardly from lateral edges 60 proximate the front of top panel 48. Forward stops 64 limit rearward sliding travel of top panel 48 relative to bottom panel 32. Thus, as top panel 48 is pushed rearwardly, relative to the bottom panel 32, forward stops 64 engage tabs 50B when aperture 35 is aligned with aperture 56 (FIGS. 2 and 4). In this manner, the movement of top panel 48 is restricted. In order to promote easy manipulation and use, a raised lip 66 may be provided at the front edge of top panel 48. A user may grasp lip 66 when inserting and removing bag assembly 22 from bracket 24, as will be hereinafter discussed.

Collar 30 may further include a flexible seal or membrane 68, positioned between bottom panel 32 and top panel 48. Flexible membrane 68 may be secured to the top surface 34 of bottom panel 32 and includes an aperture 70 concentric with aperture 35. Membrane 68 may be a rubber or plastic material that provides a seal between panels 32 and 48 to inhibit air and debris from escaping through the area between the two panels.

Figure 7:
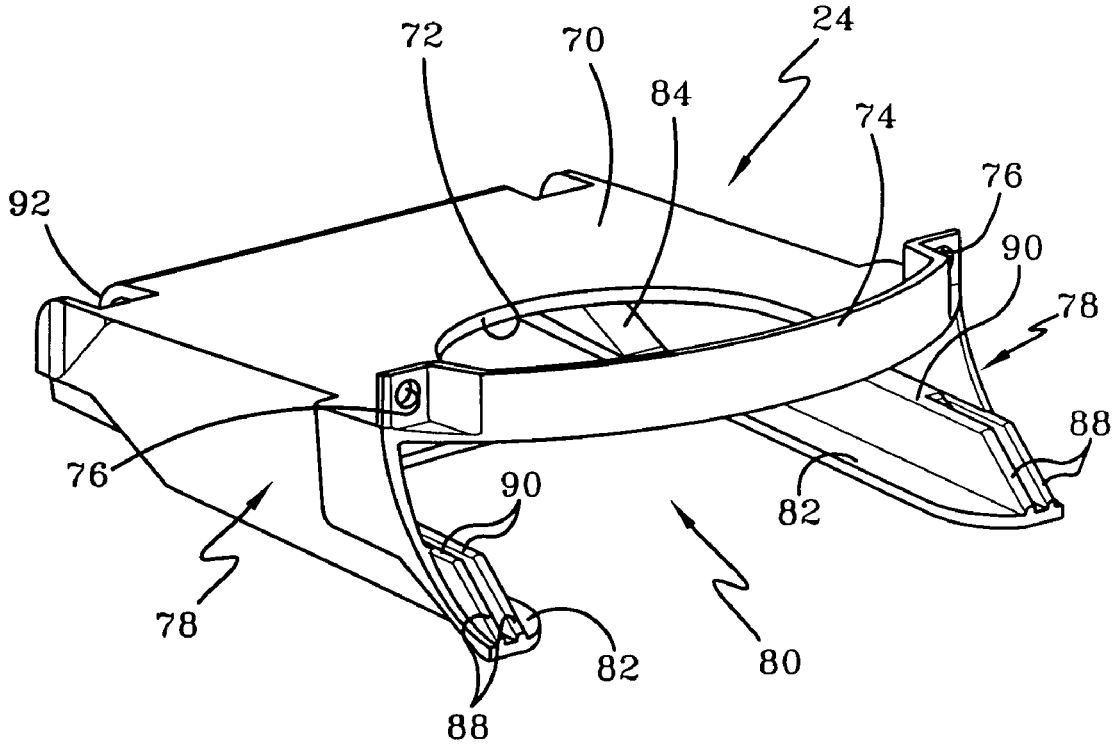
FIG. 7 is an isometric view of the receiving bracket of the present invention.
Figure 8:
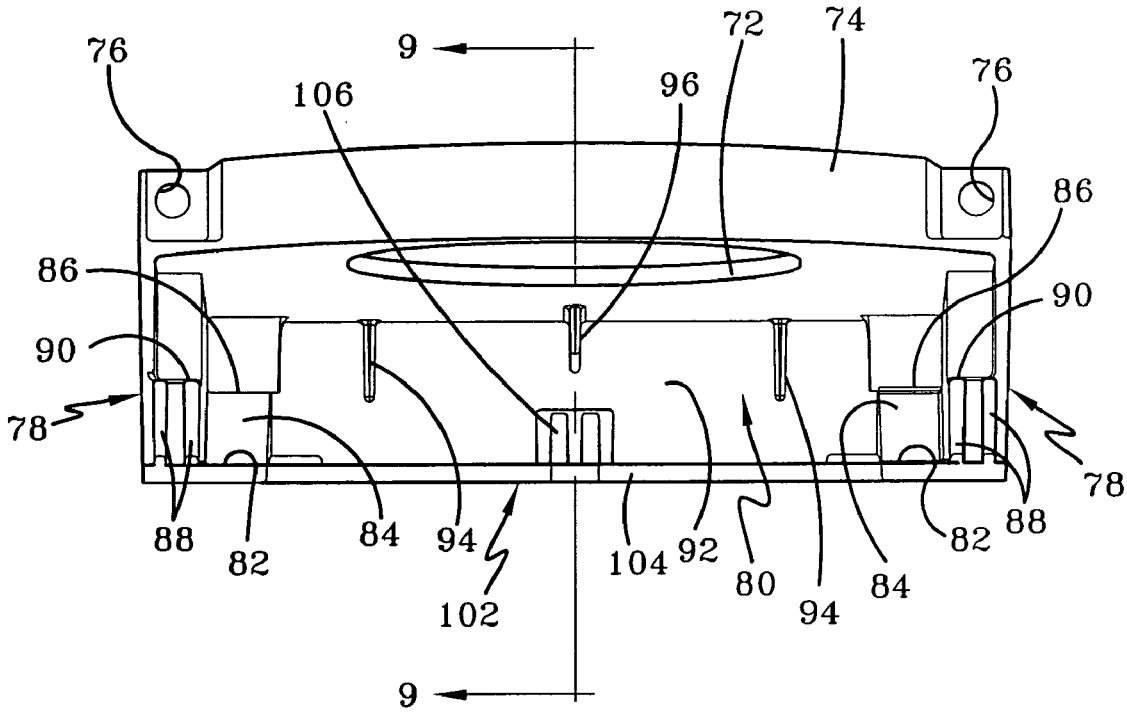
FIG. 8 is a front view of the receiving bracket.
Figure 9:
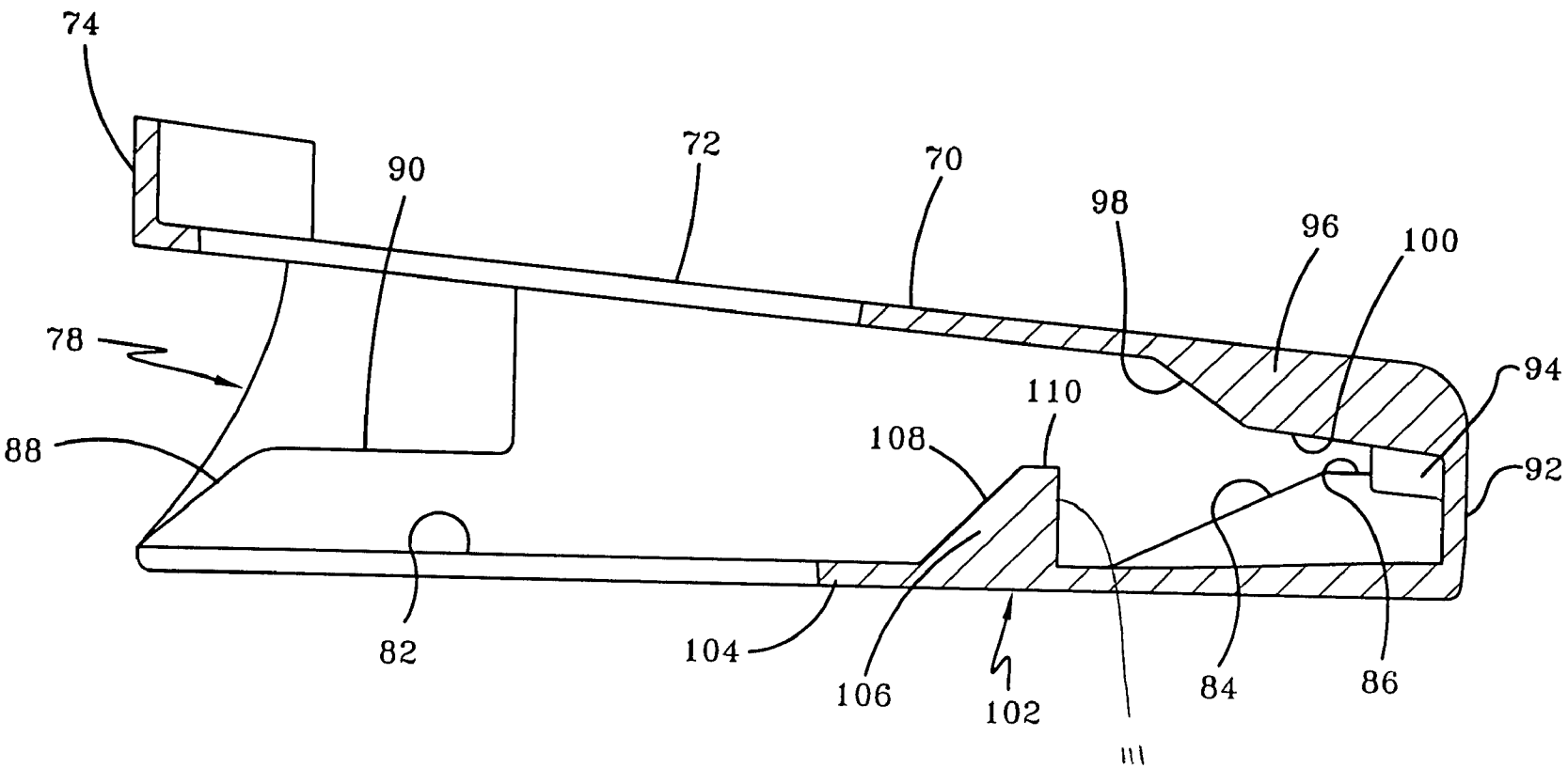
FIG. 9 is a sectional view of the receiving bracket along line 9-9 of FIG. 8.

Referring now to FIGS. 7-9, it can be seen that retaining bracket 24 includes a base plate 70 that may be generally flat and is adapted to rest against the upper wall of chamber 18. Base plate 70 is provided with an aperture 72 sized to receive nozzle 26 therethrough. An upwardly extending flange 74 may be provided on the front rim of base 70 and may include a plurality of holes 76 which are adapted to receive screws (not shown). Thus, bracket 24 may be received in compartment 18 and secured therein by screws inserted through holes 76 into corresponding holes (not shown) in compartment 18.

A pair of laterally spaced legs 78 extend downwardly from opposed sides of base plate 70. Legs 78 are adapted to selectively receive and retain collar 30. Legs 78 and base 70 thereby form a channel 80 into which nozzle 26 extends and into which collar 30 may be slidably received. Each leg 78 includes a first slide surface 82 that is upwardly facing and adapted to slidably contact a portion of the bottom surface 33, or feet 42, of bottom panel 32. First slide surface 82 may be generally planar and smooth, to promote low friction sliding of collar 30. Each first slide surface 82 terminates at a first ramp 84 that is oriented at an oblique angle relative to first slide surface 82. Thus, first ramp 84 angles upwardly from first slide surface 82 and terminates at a first resting surface 86. As is evident from FIG. 9, first resting surface 86 may be substantially parallel with first slide surface 82 and located proximate to the rear of bracket 24.

A second ramp 88 is positioned laterally outwardly of each first slide surface 82 and is adapted to contact wings 37 of bottom panel 32. Second ramp 88 may be oriented at an oblique angle relative to first slide surface 82 and at the same angle as first ramp 84. In the present embodiment second ramp 88 includes a pair of spaced surfaces, but it should be appreciated that second ramp 88 may be a single inclined surface. Second ramp 88 terminates at a second resting surface 90. As is evident from FIG. 9, second resting surface 90 may be oriented parallel with first resting surface 86 and positioned proximate the front end of bracket 24. Further, in the present embodiment a portion of second resting surface 90 includes a slotted portion, but it should be appreciated that second resting surface 90 could be a single uninterrupted surface.

Bracket 24 also includes rear wall 92 that extends downwardly from the rear edge of base plate 70 and may be secure to, or contiguous with, legs 78. A pair of rear stops 94 may extend forwardly from rear wall 92 and downwardly from base plate 70. Rear stops 94 may be laterally spaced and in the form of relatively thin projections. As will become evident, rear stops 94 limit rearward travel of collar 30, thereby locating collar 30 in correct alignment with nozzle 26. A centrally located projection 96 may also be provided that extends forwardly from rear wall 92 along base plate 70. Projection 96 is relatively thin and includes a first sliding surface 98 and a second sliding surface 100. First sliding surface 98 is disposed at a downward angle relative to base plate 70 and second sliding surface 100 may be generally parallel thereto. Projection 96 is adapted to limit upward movement of collar 30 while positioned inside bracket 24. Further, projection 96 prevents unwanted movement by providing a downward force on collar 30 when fully inserted.

Bracket 24 further includes an interference member 102 that is adapted to close collar 30 during removal from bracket 24. Interference member 102 includes a connector portion 104 that extends between, and is connected to, legs 78. A wedge 106 is carried by connector portion 104 and is positioned generally centrally thereon. Wedge 106 extends upwardly from connector portion 104 and includes ramp portion 108 that extends upwardly and rearwardly, terminating at a top surface 110 that may be oriented generally parallel with connector portion 104. Finally, a rear surface 111 may be provided that is oriented at a more acute angle than ramp portion 108. In the present embodiment, rear surface 111 is generally perpendicular to slide surface 82.

Figure 10A:
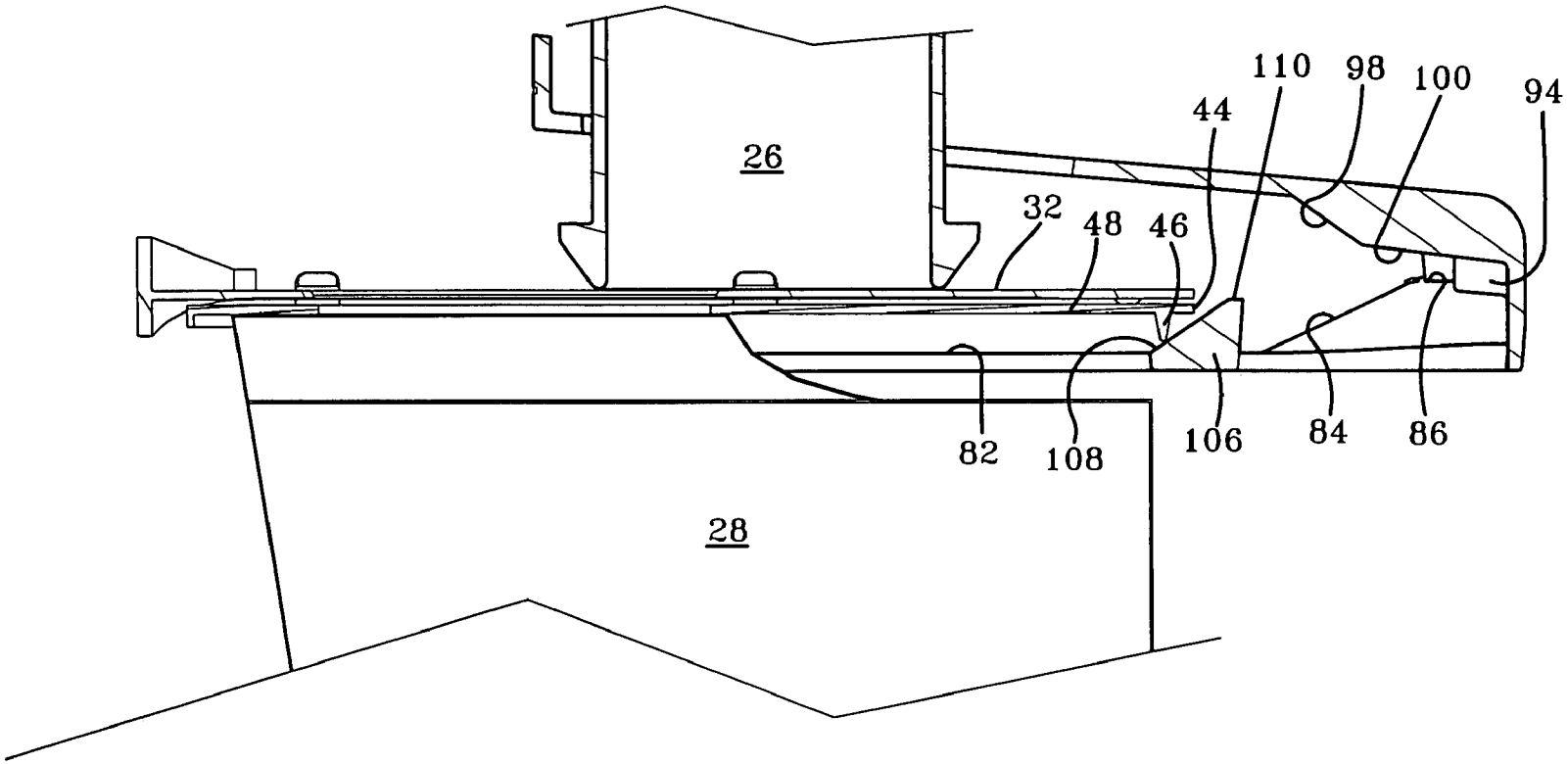
FIGS. 10A-F are sequential sectional views of the filtration bag assembly during insertion and removal from the receiving bracket.
Figure 10B:
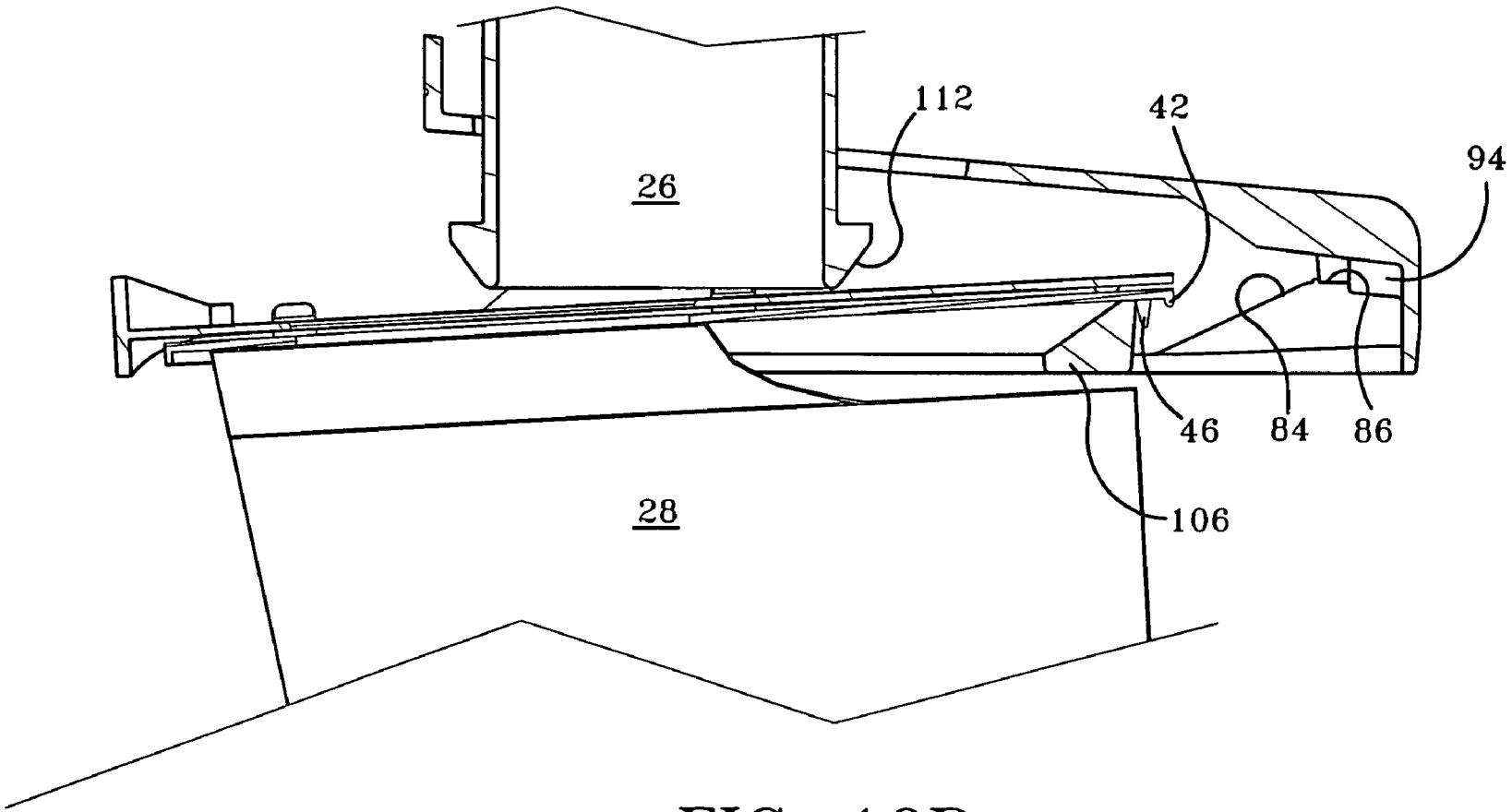
Figure 11A:
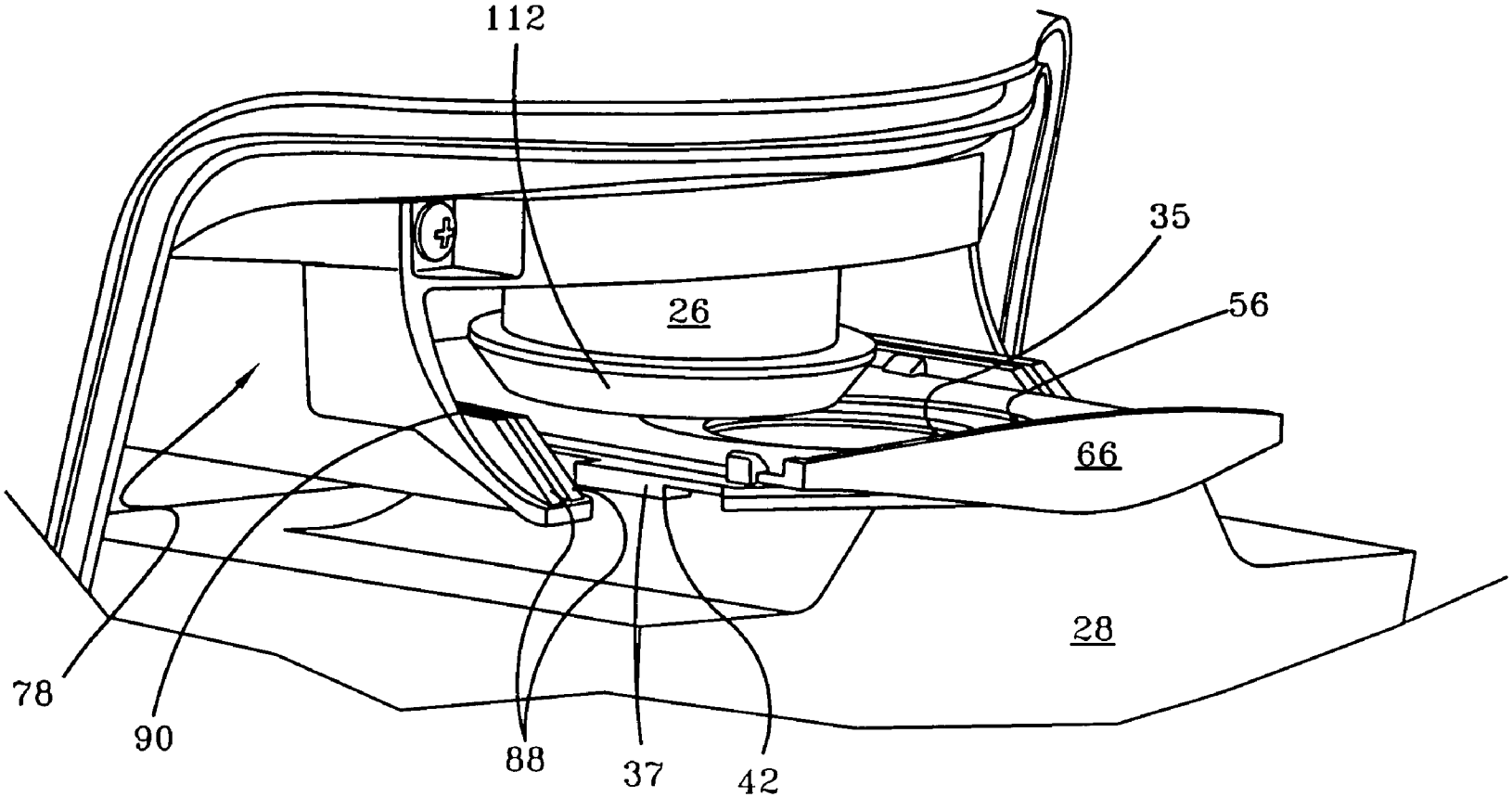
FIGS. 11A-F are sequential close-up isometric views of the filtration bag assembly during insertion and removal from the receiving bracket.
Figure 11B:
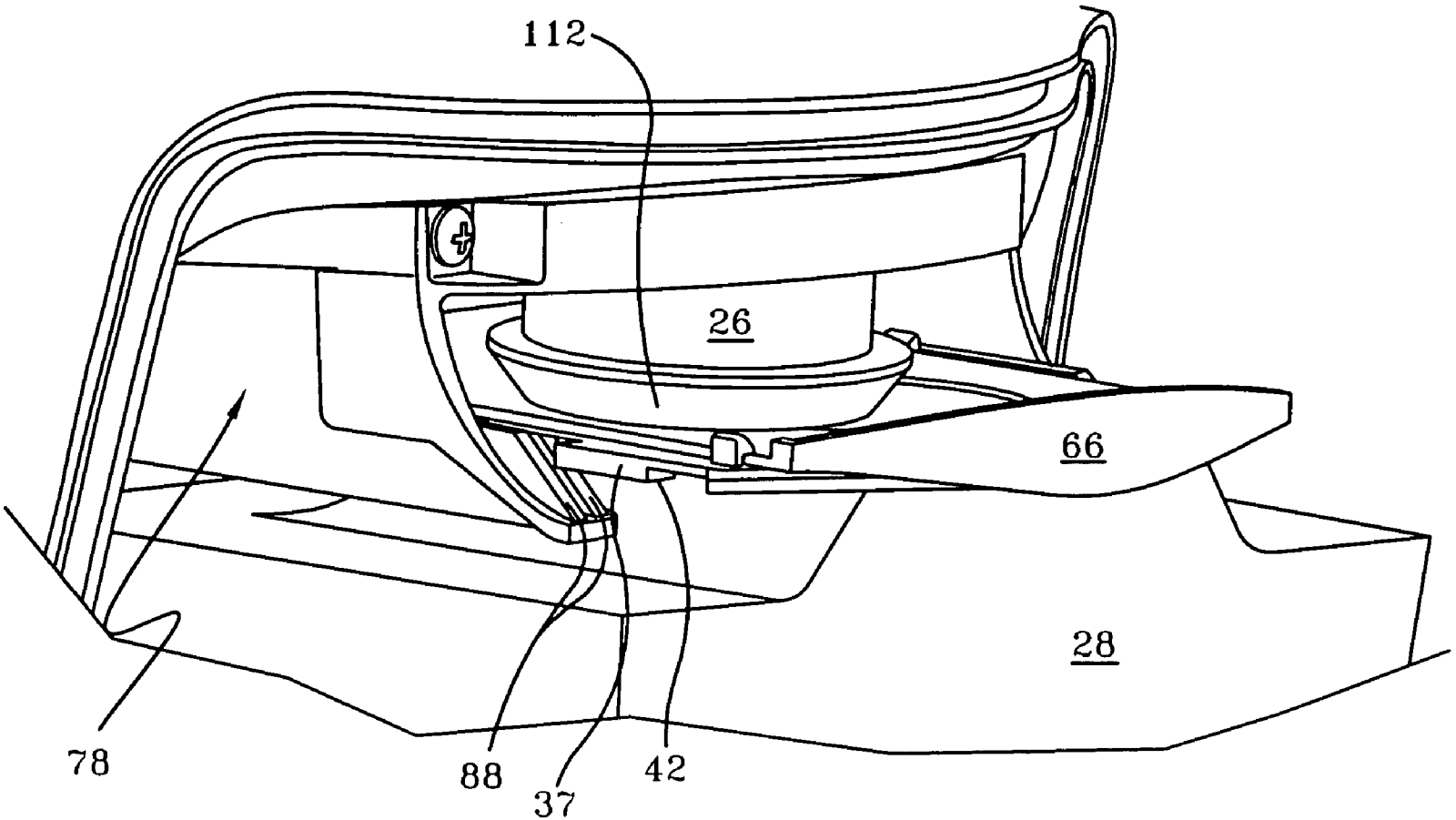

Filtration bag assembly 22 may be installed in vacuum cleaner 10 in the following manner. First, collar 30 is oriented in the first, or open position, with aperture 35 of bottom panel 32 aligned with aperture 56 of top panel 48. Bottom surface 33 of bottom panel 32 is then placed on first slide surface 82 of bracket 24. So positioned, collar 30 is moved rearwardly along first slide surface 82 until rear edge 44 or catch 46 contacts wedge 106. Continued rearward movement causes collar 30 to ride up ramp portion 108, shown in FIGS. 10A and 11A. Continued rearward collar movement draws catch 46 across and then beyond top surface 110, shown in FIGS. 10B and 11B. Proximate in time to catch 46 contacting wedge 106, wings 37 contact second ramp 88 where continued rearward movement will draw collar 30 upwardly along second ramp 88.

Figure 10C:
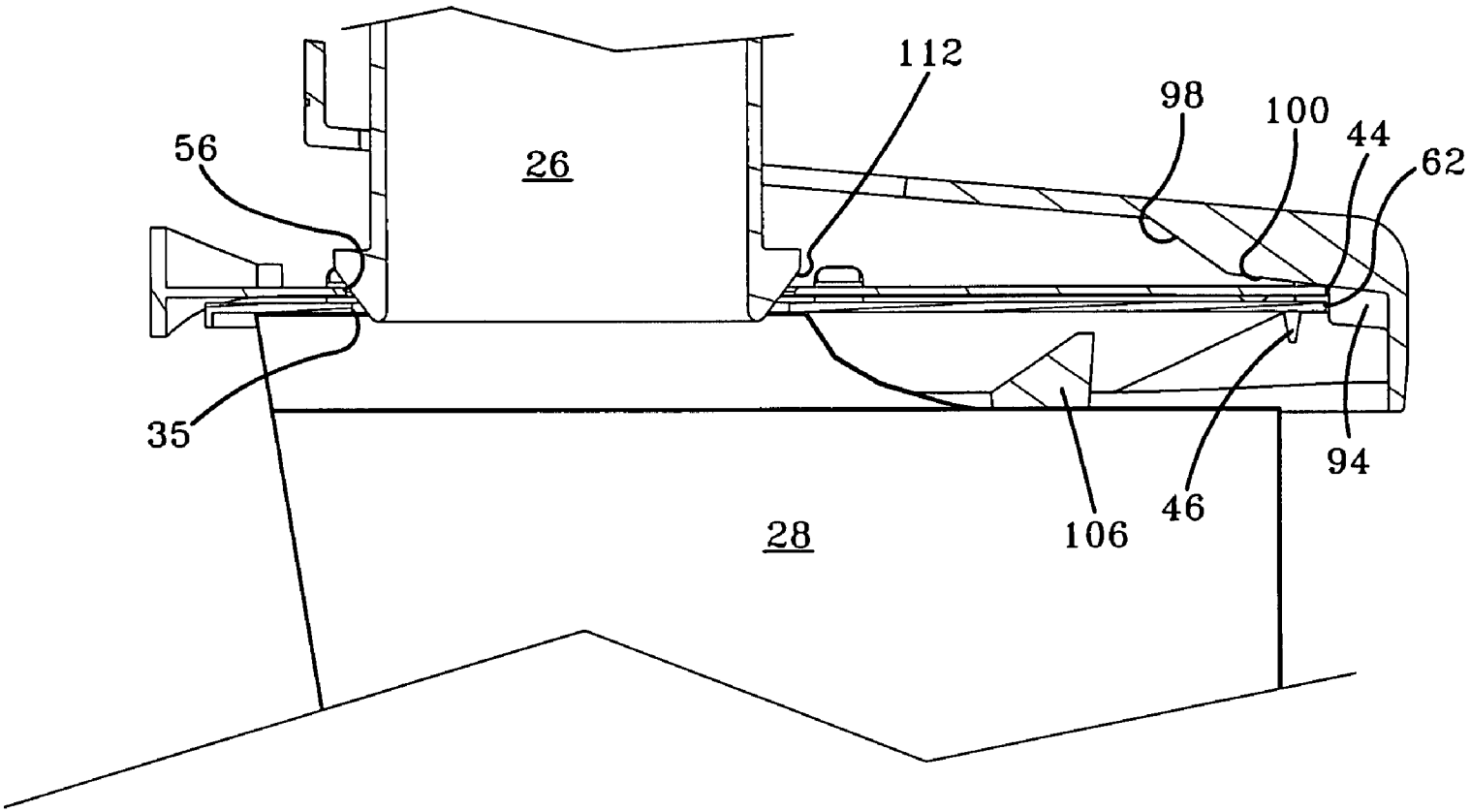
Figure 11C:
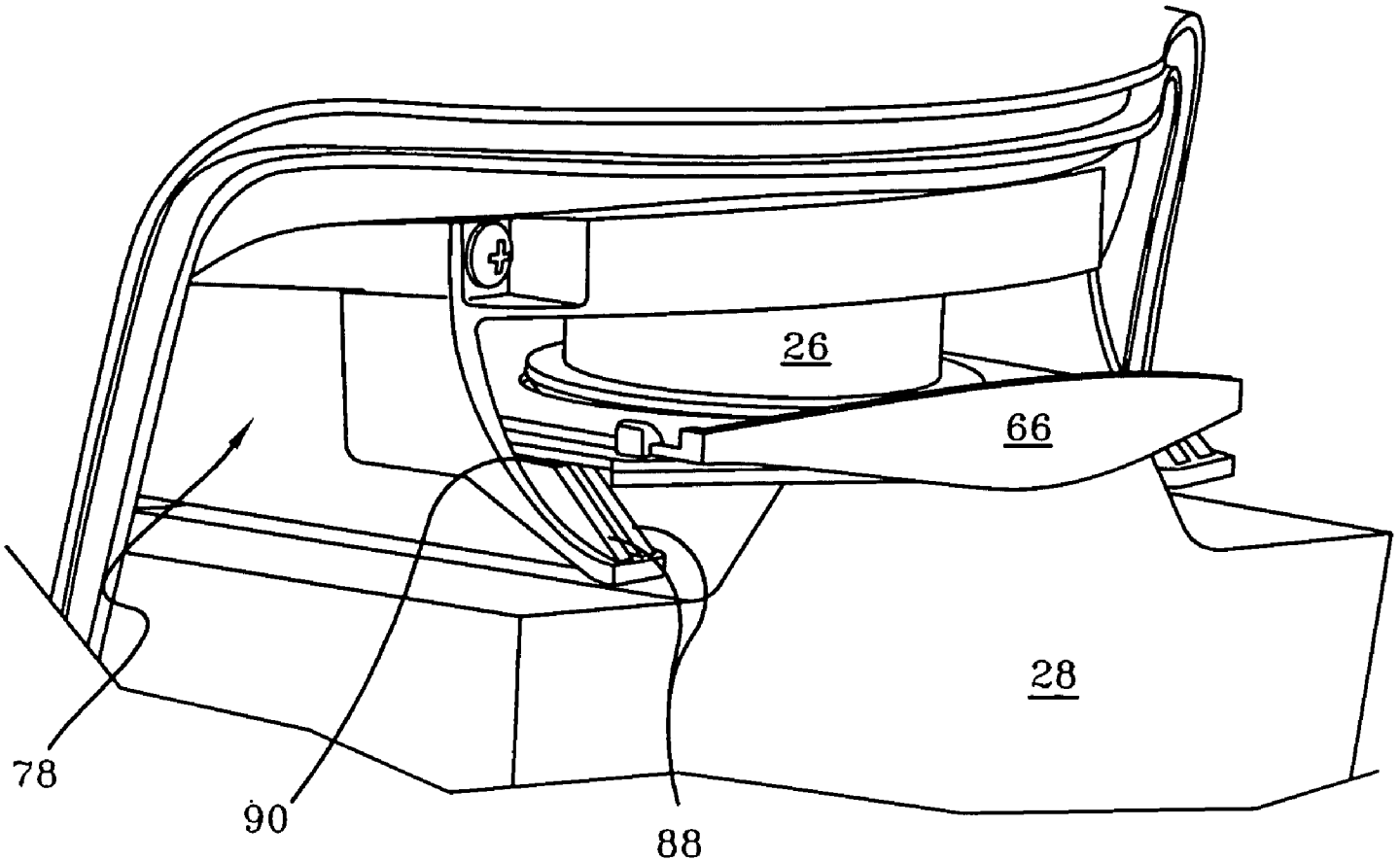

Continued rearward movement of collar 30 is finally prevented when rear edges 44 and/or 62 contact rear stops 94 thereby placing collar 30 in a locked position. In this orientation, shown in FIGS. 10C and 11C, collar 30 rests on first and second resting surfaces 86 and 90. Further, nozzle 26 is aligned with apertures 35 and 56 so that dirt laden air may be transferred into bag 28. While in this orientation, projection 96 may provide a downward static force upon collar 30, minimizing vibration and promoting a secure fit. Further, it should be appreciated that top and bottom panels 32 and 48 may be somewhat flexible and may bend or flex during insertion. Thus, if collar 30 contacts nozzle 26 during insertion, it may flex slightly inwardly. Smooth insertion is aided by an angled flange 112 provided circumferentially around nozzle 26. Thus, in this manner, bag assembly 22 is installed and ready for use.

Figure 10D:
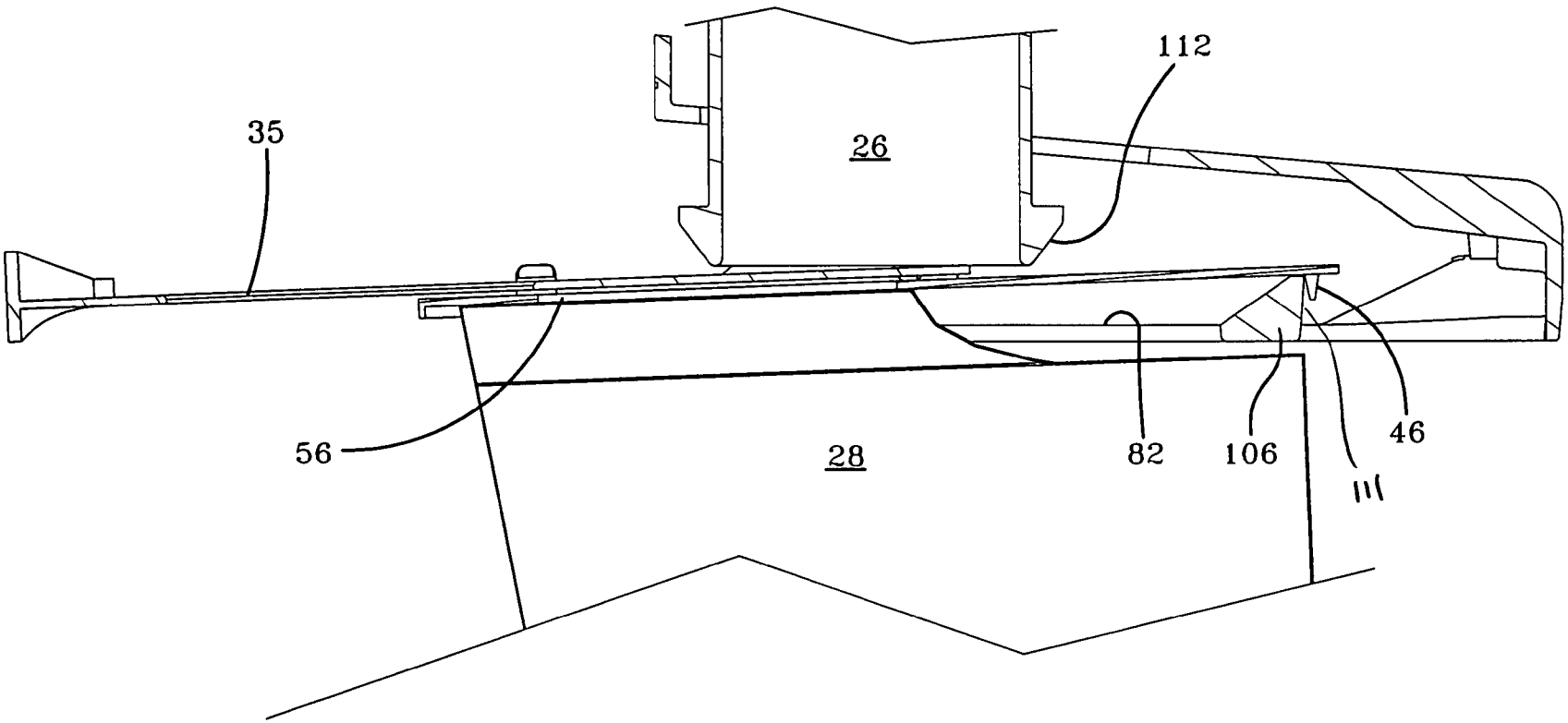
Figure 10E:
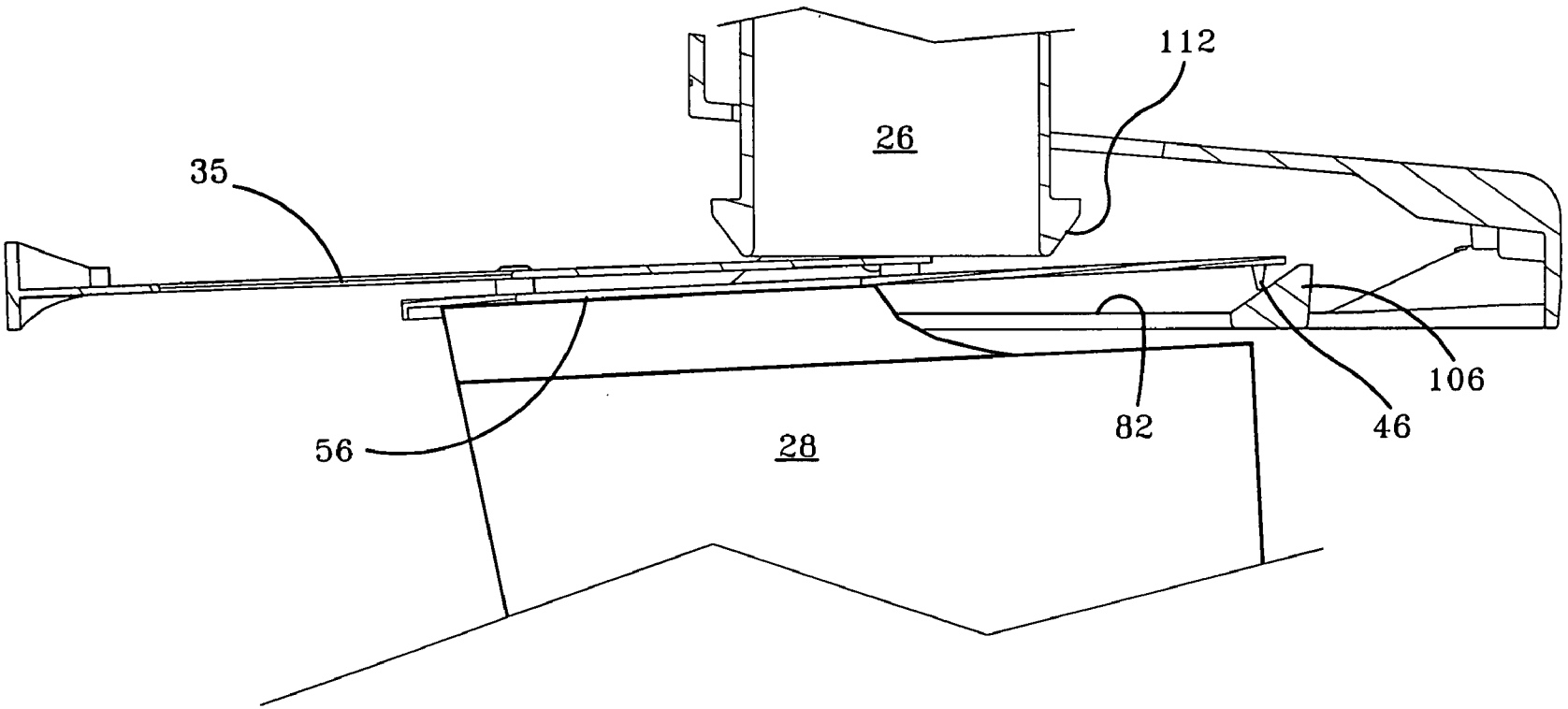
Figure 10F:
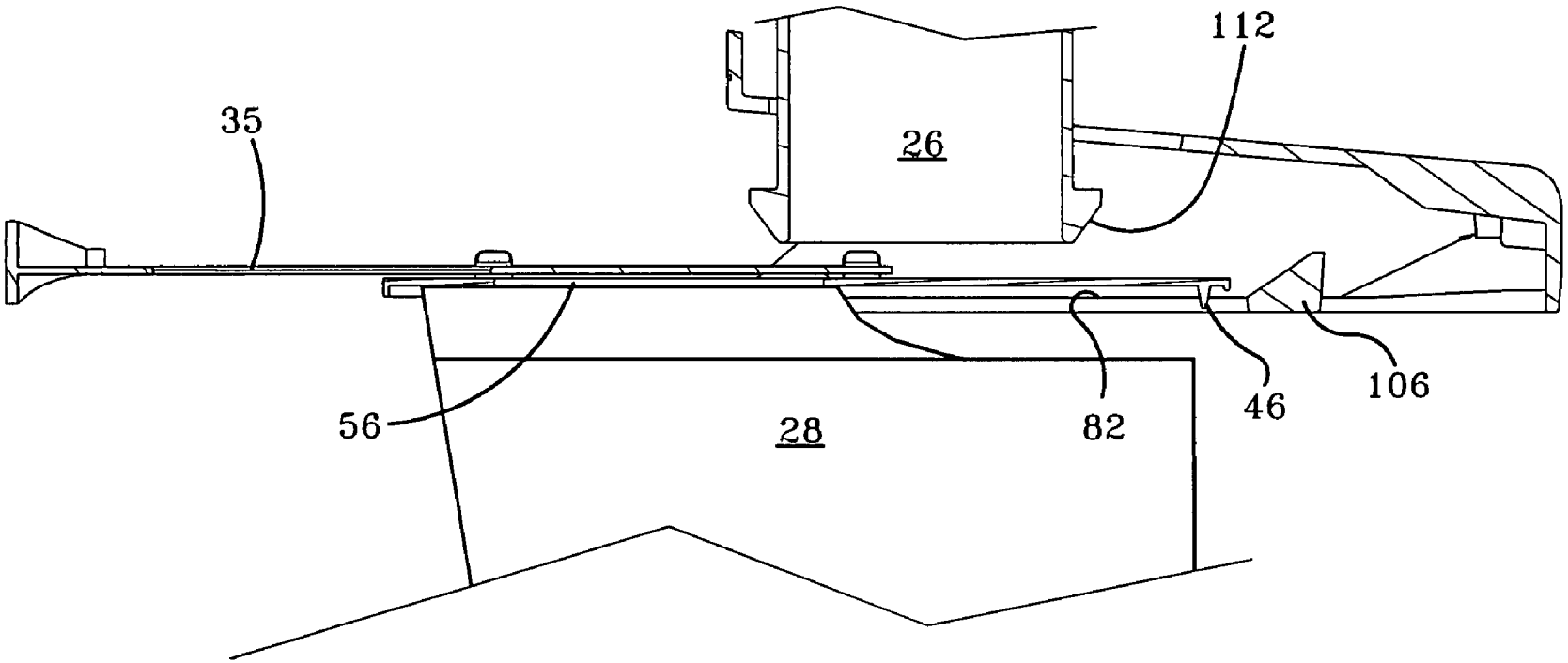
Figure 11D:
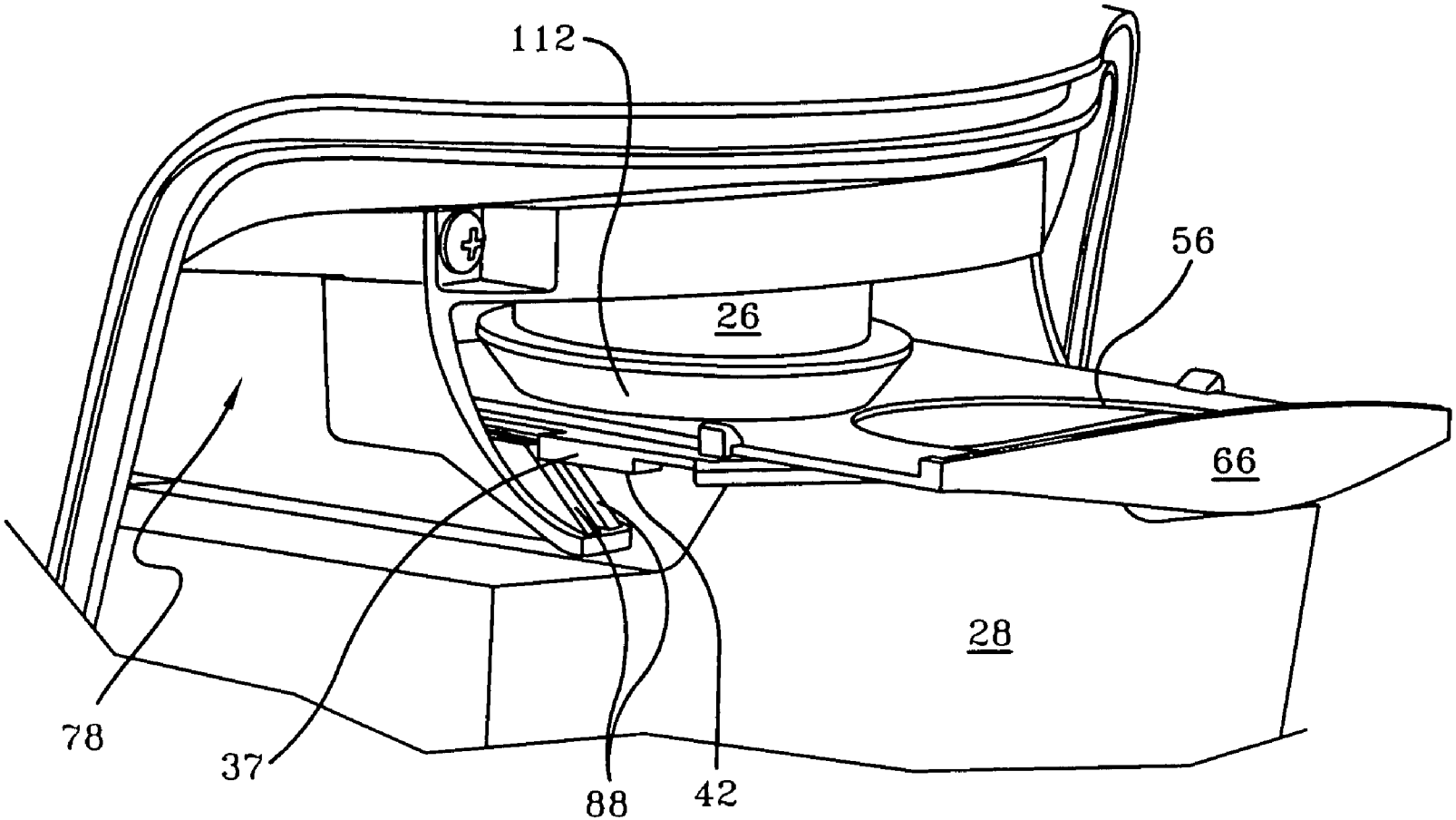
Figure 11E:
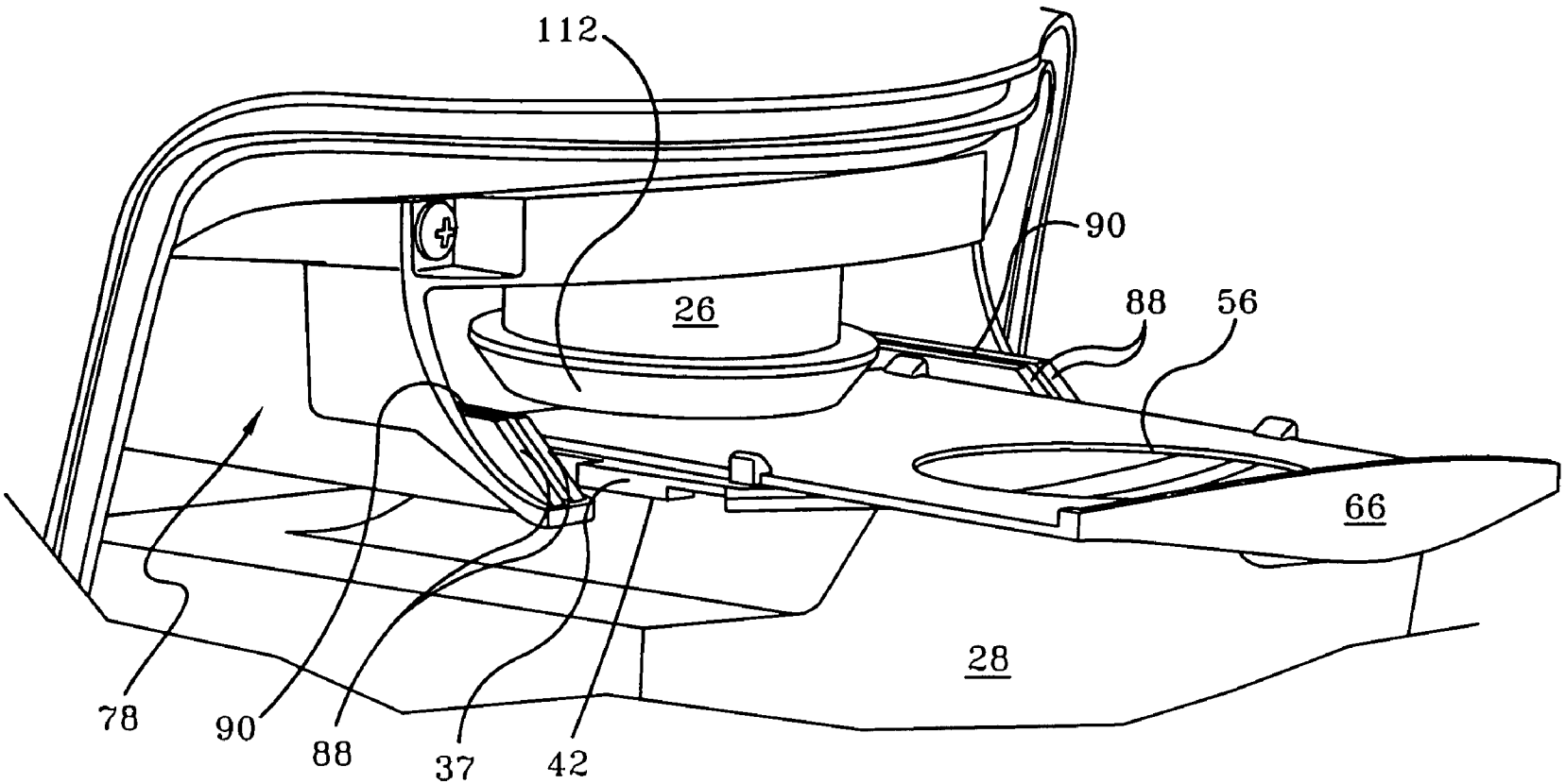
Figure 11F:
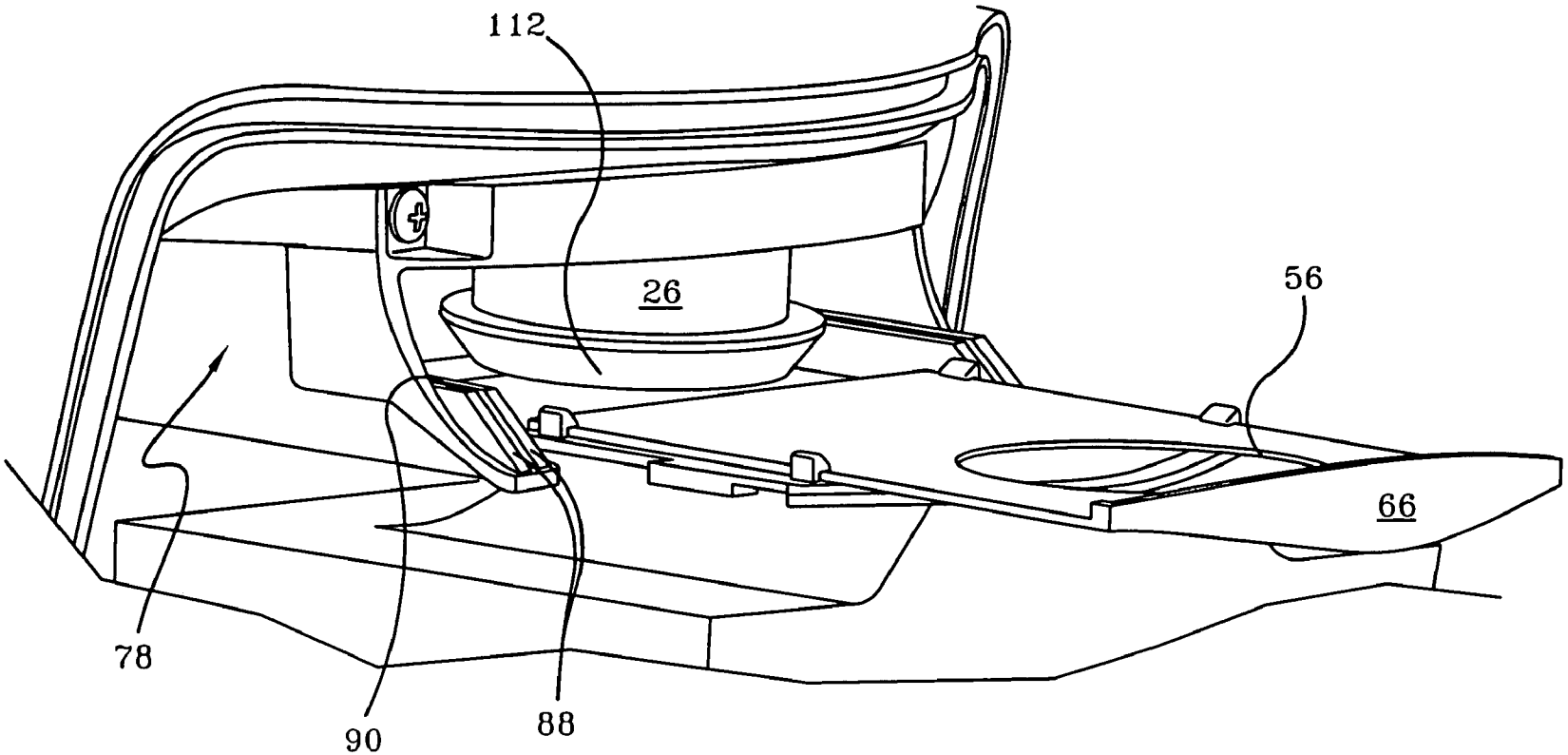

When a user wishes to remove filtration bag assembly 22 from vacuum 10, the user may grasp raised lip 66 and pull collar 30 forwardly. Under this force, collar 30 will slide forwardly and move apertures 35 and 56 out of alignment with nozzle 26. Once catch 46 contacts wedge 106, as at rear surface 111, the increased resistance will prevent bottom panel 32 from moving. Thus, top panel 48 will slide forwardly relative to bottom panel 32, as shown in FIGS. 10D and 11D. The relative sliding between bottom and top panels 32 and 48 cause apertures 35 and 56 to move out of alignment and into the second sliding position discussed above, wherein bag assembly 22 is sealed. When rear stops 58 contact clips 50A, further relative sliding between top and bottom panels is prevented. Thus, continued rearward movement will cause catch 46 to traverse wedge 106, shown in FIGS. 10E and 11E. The filtration bag assembly 22 may thereafter be removed from compartment 18 and discarded as shown in FIGS. 10F and 11F. It should be appreciated that, when removed from compartment 18, collar 30 is in the second sliding position, wherein aperture 35 is displaced from aperture 56. While in this orientation, bag 28 is sealed and no dust or debris may exit filtration bag 22.

Various modifications and alterations that do not depart from the scope and spirit of this invention will become apparent to those skilled in the art. This invention is not to be duly limited to the illustrative embodiments set forth herein.

What is claimed is:

1. A filtration bag assembly configured to be inserted into a bracket of a floor care appliance, the filtration bag assembly comprising:

an air permeable bag; and a collar affixed to the air permeable bag, said collar including:

a bottom panel including a top surface, a bottom surface and opposed lateral edges;

an opening that communicates with the interior of said bag;

a top panel that is configured to move relative to the top surface from a first orientation wherein said opening is unobstructed to a second orientation wherein said opening is obstructed; and a pair of opposed tabs extending laterally from opposed lateral edges of said bottom panel, wherein said tabs are configured to slidingly engage a ramped surface of the bracket, said ramped surface positioned proximate a front edge of the bracket, when said opening is substantially aligned with an exhaust conduit of said floor care appliance.

2. The filtration bag assembly of claim 1 wherein said bottom panel includes a bottom panel aperture and wherein said top panel includes a top panel aperture.

3. The filtration bag assembly of claim 2 wherein said opening is defined by the alignment of said bottom panel aperture and said top panel aperture.

4. The filtration bag assembly of claim 2 wherein said bottom panel includes a catch configured to engage an interference member of said bracket during removal of said collar from said bracket, said catch configured to engage said interference member to cause said top panel to slide relative to said bottom panel.

5. The filtration bag assembly of claim 4 wherein said catch includes a downwardly extending projection configured to engage an upwardly extending wedge of the interference member.

6. The filtration bag assembly of claim 4 wherein said catch includes a generally triangular shape.

7. The filtration bag assembly of claim 2, wherein the bottom panel has a plurality of retaining clips that extend from the opposed lateral edges for slidably securing the top panel to the bottom panel in surface to surface contact.

8. The filtration bag assembly of claim 2, wherein said top panel includes a pair of rear stops to limit the forward sliding travel of top panel relative to bottom panel to prevent the panels from dislocating.

9. The filtration bag assembly of claim 2, wherein said top panel has lateral edges and includes a pair of forward stops extending outwardly from lateral edges to limit rearwardly sliding travel of top panel relative to bottom panel to align the aperture of the top panel with the aperture of the bottom panel.

10. A floor cleaning appliance comprising:

a body including a filtration bag compartment;

a bag retaining bracket secured within the filtration bag compartment and configured to receive a collar of a filtration bag, wherein the bag retaining bracket includes:

a pair of opposed legs, wherein each leg includes a first ramp surface and a second ramp surface; and an interference member configured to engage a catch extending from said collar of said dirt collection bag.

11. The floor cleaning appliance of claim 10 wherein each said leg includes a first slide surface that terminates at said first ramp surface, said first slide surface being positioned laterally inwardly relative to said second ramp surface and configured to slidingly contact a bottom surface of said collar when said filtration bag assembly is inserted into said bracket.

12. The floor cleaning appliance of claim 10 wherein said first ramp surface and said second ramp surface are substantially parallel.

13. The floor cleaning appliance of claim 10 wherein each said leg further includes a first resting surface and a second resting surface, said first resting surface extending rearwardly from said first ramp surface and said second resting surface extending rearwardly from said second ramp surface.

14. The floor cleaning appliance of claim 10 wherein said interference member includes a wedge having an upwardly sloped ramp portion that terminates at a top surface.

15. The floor cleaning appliance of claim 14 wherein the bracket is configured such that rearward movement of said collar into said bracket causes said catch to ride up said wedge portion to traverse said interference member, and forward motion of said collar causes said catch to engage said interference member and inhibit continued sliding movement until said collar moves from said first orientation to said second orientation.

* * * * *